US005669071A

United States Patent [19]

Vu

[11] Patent Number: 5,669,071

[45] Date of Patent: Sep. 23, 1997

[54] FOLDABLE VISOR FOR CAP

[76] Inventor: Thien C. Vu, 28 Alpine Way, Asheville, N.C. 28805

[21] Appl. No.: 540,654

[22] Filed: Oct. 11, 1995

[51] Int. Cl.[6] ..... A42B 1/06

[52] U.S. Cl. ..... 2/10; 2/9; 2/195.1; 2/206

[58] Field of Search ..... 2/6.3, 6.5, 6.7, 2/7, 8, 9, 10, 12, 15, 173, 195.1, 206, 209.13, 424

[56] References Cited

U.S. PATENT DOCUMENTS

| | | | |
|---|---|---|---|
| 911,432 | 2/1909 | Pachner . | |
| 1,232,812 | 7/1917 | Kirchner | 2/10 |
| 1,313,469 | 8/1919 | Crossley | 2/12 |
| 2,648,847 | 5/1953 | Crowder . | |
| 4,304,005 | 12/1981 | Danley, Sr. | 2/209.13 |
| 4,777,667 | 10/1988 | Patterson et al. . | |
| 4,951,319 | 8/1990 | Phillips, Jr. et al. . | |
| 5,261,124 | 11/1993 | Day | 2/10 |

*Primary Examiner*—Diana Biefeld
*Attorney, Agent, or Firm*—Bush, Riddle & Jackson, L.L.P.

[57] ABSTRACT

A cap (10) having a crown portion (12) for fitting about the head of a wearer and a relatively narrow stiff brim (18) extending outwardly from the crown portion (12). A visor (20) overlaps the brim (18) and a hinge (32) is secured to the lower surfaces of the brim (18) and the visor (20). The visor (20) may be pivoted manually to a desired angular relation with the brim (18). The visor (20) is preferably formed of a transparent tinted material and may be folded downwardly in front of the eyes of the wearer to shield the eyes from the sunlight or glare as desired.

9 Claims, 1 Drawing Sheet

FIG. 1
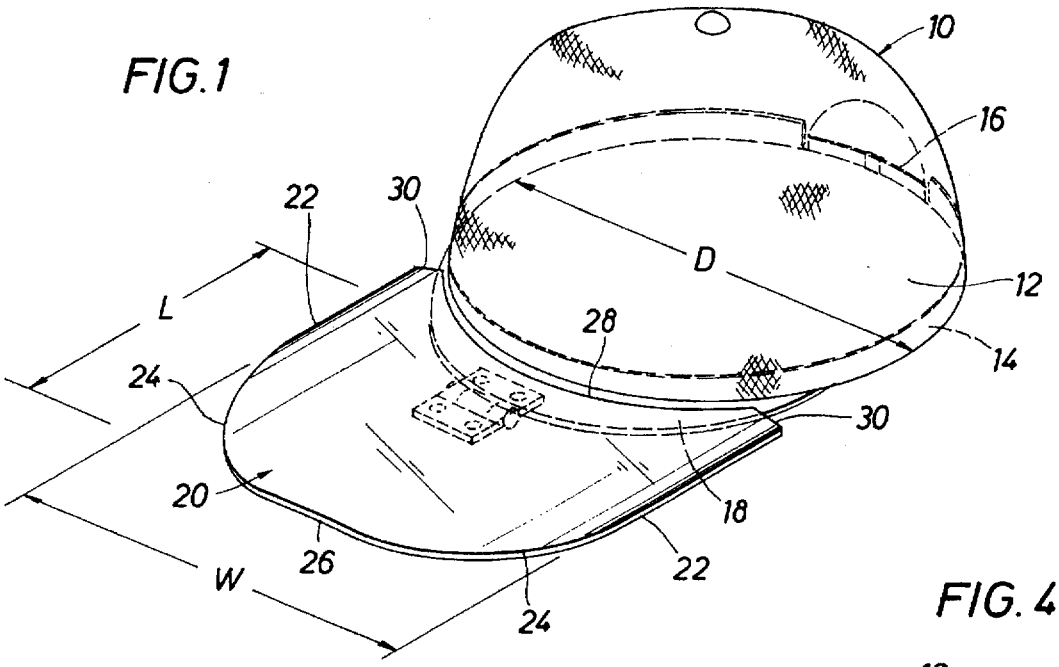
FIG. 2
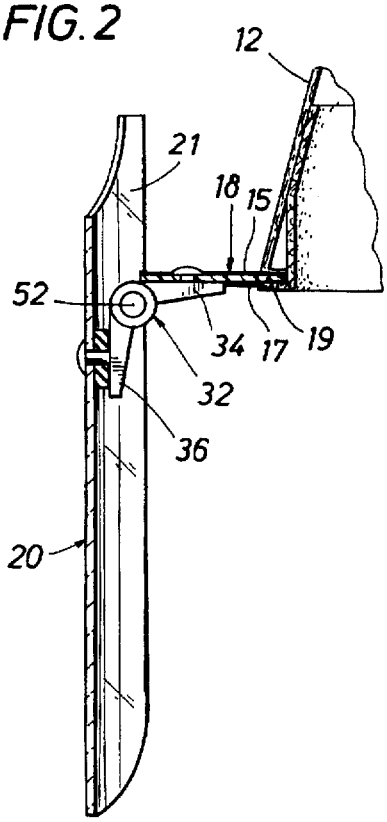
FIG. 4
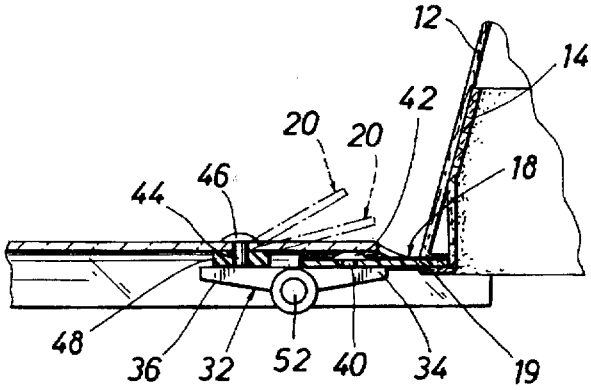
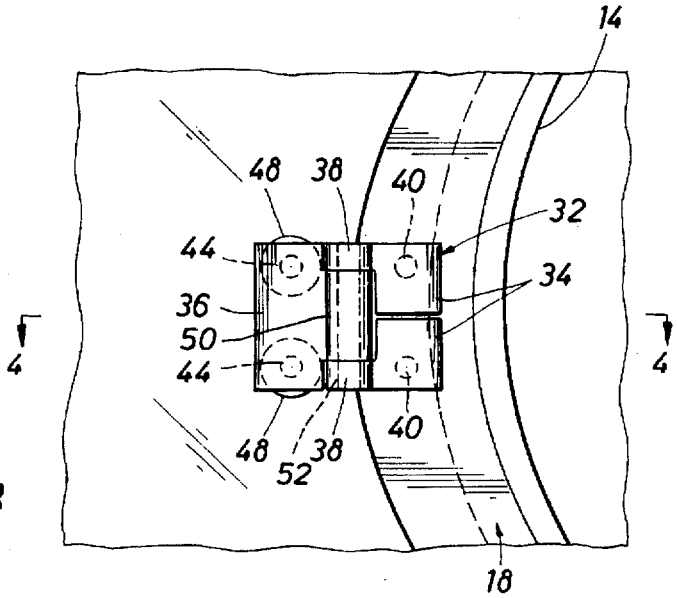
FIG. 3

FOLDABLE VISOR FOR CAP

FIELD OF THE INVENTION

This invention relates to a foldable visor for a cap, and more particularly to such a foldable visor which is mounted on the cap for manual adjustment to a plurality of positions relative to the cap as may be desired.

BACKGROUND OF THE INVENTION

Heretofore, caps have been provided with visors or bill portions that are foldable between one position when the visor or bill portion is being utilized and another position when the visor or bill portion is not being utilized. Also, visors have been provided heretofore which are foldable to present different areas of the visor for viewing. However, such visor or bill portions have been mounted on the outer edge or outer periphery of the crown portion of the cap for folding movement relative to the cap. For example, U.S. Pat. Nos. 2,648,847; 4,777,667; and 4,951,319 show various types of foldable visors or bills.

Also, transparent visors or bills have been mounted previously on caps. For example, U.S. Pat. No. 911,432 shows a transparent visor fixed to the lower edge of the crown of a cap. U.S. Pat. No. 5,261,124 shows an eye shield removably mounted on the bill of a cap and pivotally adjusted to a desired angle. A separate mounting structure is removably mounted on the bill to support the eye shield.

It is desirable that a simplified mounting means be provided for an adjustable eye shield or visor for a cap.

SUMMARY OF THE INVENTION

The present invention is directed to a cap having a foldable visor mounted on the cap for manual adjustment to a plurality of positions relative to the crown of the cap as desired. The visor has an extended bill portion and is preferably formed of a transparent or translucent material so that the user may use the visor as sunglasses or an eye shield. The visor may also be of an opaque material for some uses. The crown portion of the cap has a narrow generally crescent shaped narrow brim fixed on the front portion of the cap and extending forwardly of the crown portion. The foldable visor is hinged to the relatively rigid brim for adjustment of the visor to a desired angle. A leaf type hinge is mounted on the brim and has a foldable leaf secured to the visor to permit pivotal movement of the visor to a desired angle relative to the eyes of a wearer of the cap. However, other suitable hinges may be utilized in a satisfactory manner.

Other features and advantages of this invention will be apparent from the following specifications and drawings.

BRIEF DESCRIPTION OF THE DRAWINGS

FIG. 1 is a perspective view of a cap including a visor comprising the present invention;

FIG. 2 is an enlarged section of the visor hinged to the brim and folded downwardly for shielding the eyes of a wearer;

FIG. 3 is an enlarged bottom plan of the hinge secured between the brim and visor; and FIG. 4 is an enlarged section taken generally along lines 4—4 of FIG. 3 and showing the visor hinged to the narrow brim fixed to the crown portion of the cap.

DESCRIPTION OF THE INVENTION

Referring to the drawings for a better understanding of this invention, a cap including the present invention is shown generally at 10 and may, for example, be used as a golf cap or baseball cap. Cap 10 includes a crown portion 12 for fitting on the head of a user. An inner sweat band 14 extends along the inner periphery of the crown portion 12 and a rear adjustable band 16 is provided so that a single cap size may be used for all sizes as well known.

A relatively narrow crescent shaped brim 18 is secured to crown portion 12 and extends forwardly of crown portion 12 from the front of cap 10. Brim 18 has an upper surface 15 and a lower surface 17. Brim 18 has an inner generally rigid plastic layer 19 to provide stiffness. Brim 18 defines a mounting surface for a visor shown generally at 20. Crown portion 12 and brim 18 are preferably constructed of suitable fabric materials formed from synthetic or natural fibrous materials, for example. Visor 20 is preferably formed of a tinted transparent or translucent material, but may, if desired, be formed of an opaque or other materials. Visor 20 has a lower surface 21. Visor 20 is of a length L from crown portion 12 at least around ½ the diameter D of crown portion 12 but may extend to around ¾th of the diameter D of crown portion 12 under certain conditions. Width W is at least around ⅔rd of the diameter D of crown portion 12 but may be as great as or slightly greater than diameter D under certain conditions. It is desirable that visor 20 be of width W and length L sufficient to block the sun or glare from the eyes of a wearer of cap 10 when visor 20 is in a lowered operable position as will be explained further. For example, a width W of 7 ½ inches and a length L of 4½ inches has been found to be satisfactory for cap 10 having a diameter D of 7½ inches. Visor 20 has a pair of side edges 22 which extend in a parallel relation for a major portion of the length L of visor 20 and then curves inwardly at forward edge 24 to form the forward apex 26 of cap 10. The rear edge 28 of visor 20 overlaps brim 18 and is of an arcuate shape generally similar to the adjacent outer peripheral surface of crown portion 12. Corner edge portions 30 connect opposed ends of arcuate rear edge 28 with parallel side edges 22 and extend in a right angular relation to side edges 22.

To mount visor 20 for folding movement on brim 18, a hinge generally indicated at 32 is provided. Hinge 32 has interfitting leaves 34 and 36. Leaves 34 have spaced end hubs 38 and a pair of rivets 40 extend through suitable openings in brim 18 with heads 42 of rivets gripping brim 18 for securement of leaves 34 onto brim 18. Leaf 36 has a pair of rivets 44 which extend through suitable openings in visor 20 with heads 46 of rivets 44 engaging visor 20 to clamp visor 20 tightly. Plastic spacers 48 fit about rivets 44 for positioning visor 20 above brim 18. An outer hub 50 on leaf 36 fits between end hubs 38 on leaves 34 and a threaded pin 52 is received within interfitting hubs 38, 50 to connect leaves 34, 36 together for relative pivotal movement. Pin 52 controls the frictional contact between hubs 38, 50 to permit manual adjustment of visor 20 to a desired position at which visor 20 is maintained by frictional contact between hubs 38, 50. While rivets 40 and 44 have been illustrated as suitable fasteners for hinge 32, other types of fasteners may be utilized if desired, such as threaded screws with suitable nuts. Further, if desired, integral recessed bosses may be provided on the inner surface of visor 20, and leaf 36 may be secured to the bosses thereby eliminating exposed fasteners on the upper surface of visor 20.

Visor 20 is preferably formed of a transparent tinted material to shield the eyes of a wearer and is manually pivoted to the position of FIG. 2 when it is desired to use visor 20 as sunglasses to shield the sun or glare from the wearer. Visor 20 may also be positioned when the wearer is driving a vehicle at various inclined positions dependent on the position of the sun in a manner similar to a sun visor on an automobile, for example.

While a preferred embodiment of the present invention has been illustrated in detail, it is apparent that modifications and adaptations of the preferred embodiment will occur to those skilled in the art. However, it is to be expressly understood that such modifications and adaptations are in the spirit and scope of the present invention as set forth in the following claims.

What is claimed is:

1. A cap for the head of a wearer comprising:

a crown portion for fitting about the head of a wearer;

a relatively narrow and stiff brim extending from said crown portion and having opposed upper and lower surfaces;

a visor extending from said brim and having a lower surface covering a substantial portion of said brim when in a raised position; and a hinge having a pair of leaves, one leaf secured to the lower surface of the brim and the other leaf secured to the lower surface of the visor whereby said visor is mounted for manual pivotal movement relative to said brim to lower said visor to a desired angular relation forwardly of said brim and crown portion to form a sun shield.

2. A cap as set forth in claim 1 wherein said leaves have a frictional engagement with each other sufficient to maintain said visor in a predetermined position after being manually positioned in such predetermined position.

3. A cap as set forth in claim 1 wherein said crown portion has an outer peripheral surface and said visor has an arcuate rear edge with a shape generally similar to said outer peripheral surface of said crown portion said arcurate rear edge overlapping said brim adjacent said crown portion.

4. A cap as set forth in claim 3 wherein said visor has a pair of generally parallel side edges extending for a major portion of the length of said visor and defining the width of said visor therebetween, said width of said visor being at least around ⅔rds the diameter of said cap and forming a bill for said cap.

5. A cap as set forth in claim 4 wherein said visor has an arcuate front edge extending between and connecting said parallel side edges.

6. A cap as set forth in claim 3 wherein said visor is formed of a transparent tinted material.

7. A cap for the head of the wearer comprising:

a crown portion for fitting about the head of a wearer and having an outer arcuate peripheral surface;

a relatively narrow and stiff brim extending outwardly from said crown portion and having opposed upper and lower surfaces;

a visor having a lower surface overlapping said brim in a raised position and having an arcuate rear edge with a shape generally similar to said outer arcuate peripheral surface of said crown portion; and a hinge having a pair of leaves, one leaf secured to the lower surface of the brim and the other leaf secured to the lower surface of the visor whereby said visor is mounted for relative manual pivotal movement forwardly of said brim to lower said visor to a desired angular relation forwardly of said brim.

8. A cap as set forth in claim 7 wherein said visor is formed of a transparent tinted material to shield the eyes of a wearer.

9. A cap as set forth in claim 7 herein said visor has a pair of generally parallel side edges extending for a major portion of the length of said visor and defining the width of said visor therebetween, said width of said visor being at least around ⅔rds the diameter of said cap and forming a bill for said cap.

* * * * *